US005383664A

United States Patent [19]

Epperson

[11] Patent Number: 5,383,664

[45] Date of Patent: Jan. 24, 1995

[54] GOLF PUTTER AND PUTTER HEAD

[75] Inventor: Bert P. Epperson, Gadsden, Ala.

[73] Assignee: Epperson-Thompson Golf, L.L.C., Birmingham, Ala.

[21] Appl. No.: 84,868

[22] Filed: Jun. 30, 1993

[51] Int. Cl.[6] ..... A63B 53/04

[52] U.S. Cl. ..... 273/167 B; 273/167 J; 273/175

[58] Field of Search ..... 273/167 R, 167 B, 167 C, 273/167 D, 167 J, 167 F, 169, 175, 164.1, 77 R

[56] References Cited

U.S. PATENT DOCUMENTS

| | | | |
|---|---|---|---|
| 1,437,463 | 12/1922 | Boye | 273/175 X |
| 1,525,137 | 2/1925 | Lawton | 273/175 |
| 3,333,854 | 8/1967 | White | 273/167 B |
| 3,869,126 | 3/1975 | Thompson | 273/175 |
| 3,989,257 | 11/1976 | Barr | 273/167 J X |
| 4,077,633 | 3/1978 | Studen | 273/175 X |
| 4,162,074 | 7/1979 | Thomson | 273/175 |
| 4,413,825 | 11/1983 | Sasse | 273/175 |
| 4,461,482 | 7/1984 | Bojicic | 273/175 X |
| 4,508,342 | 4/1985 | Drake | 273/167 C X |
| 4,693,478 | 9/1987 | Long | 273/169 X |
| 4,702,477 | 10/1987 | Solomon | 273/169 X |
| 4,881,739 | 11/1989 | Garcia | 273/175 X |

FOREIGN PATENT DOCUMENTS

| | | | |
|---|---|---|---|
| 1205098 | 5/1986 | Canada | 273/167 B |
| 27807 | 12/1911 | United Kingdom | 273/167 B |
| 637948 | 5/1950 | United Kingdom | 273/175 |

*Primary Examiner*—Sebastiano Passaniti

[57] ABSTRACT

A golf putter and putter head are disclosed which incorporates an angled or lofted and limited impact surface which imparts to a golf ball minimal lift without imparting significant undesirable backspin or skid to the ball, thereby minimizing loss of control adversely affect accuracy of the ball's moving toward the hole or target.

22 Claims, 3 Drawing Sheets

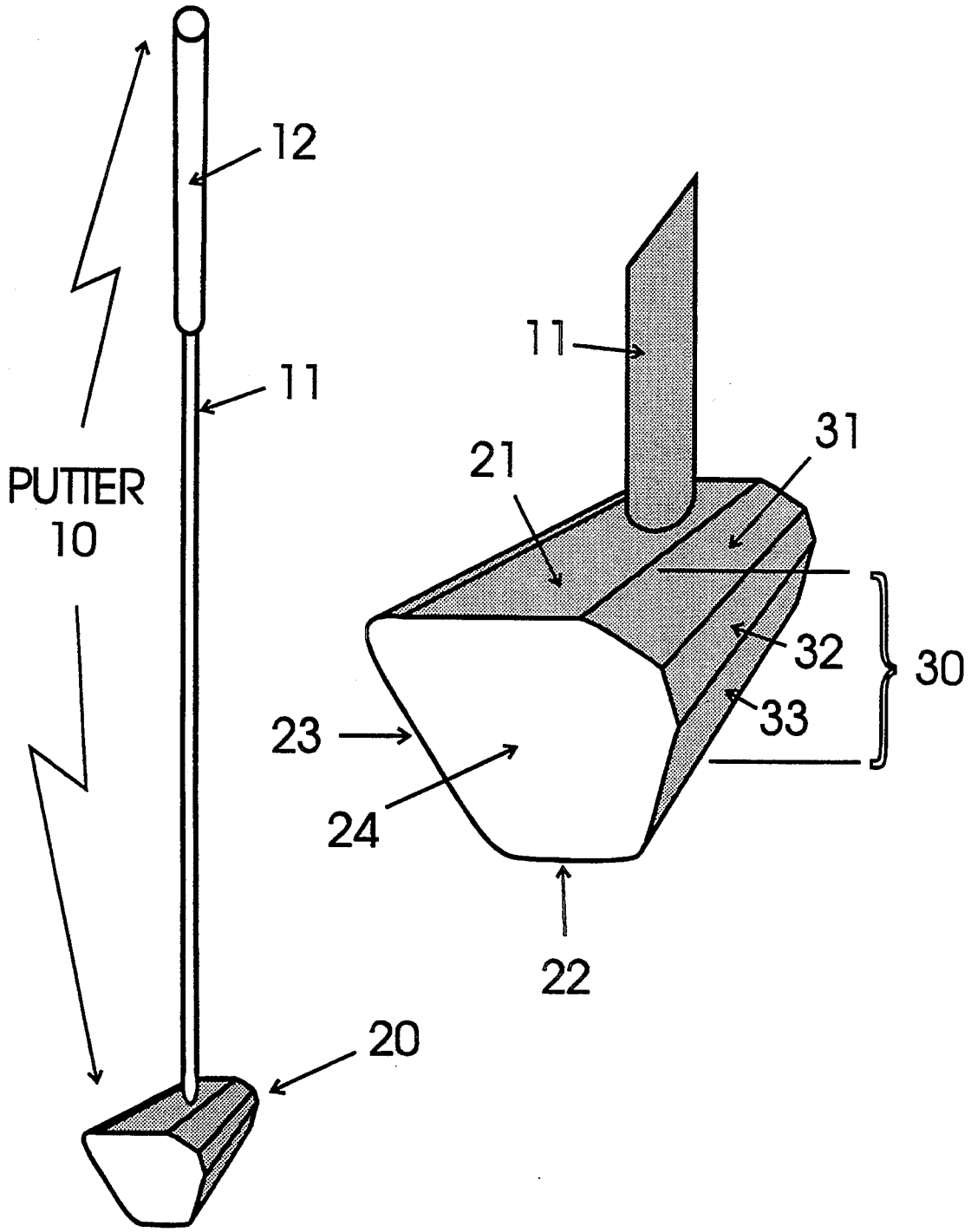
FIG. 1 Perspective View

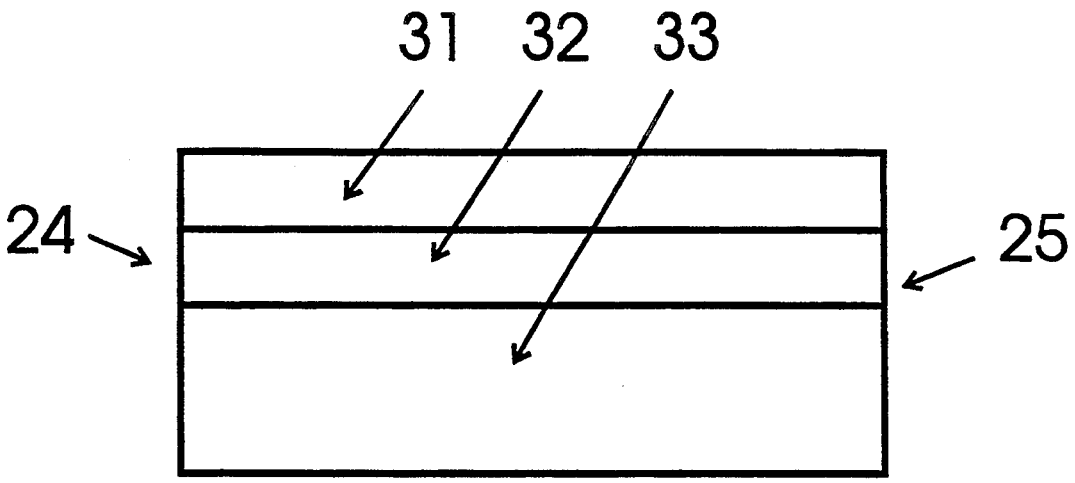
FIG. 2 Front Plan View
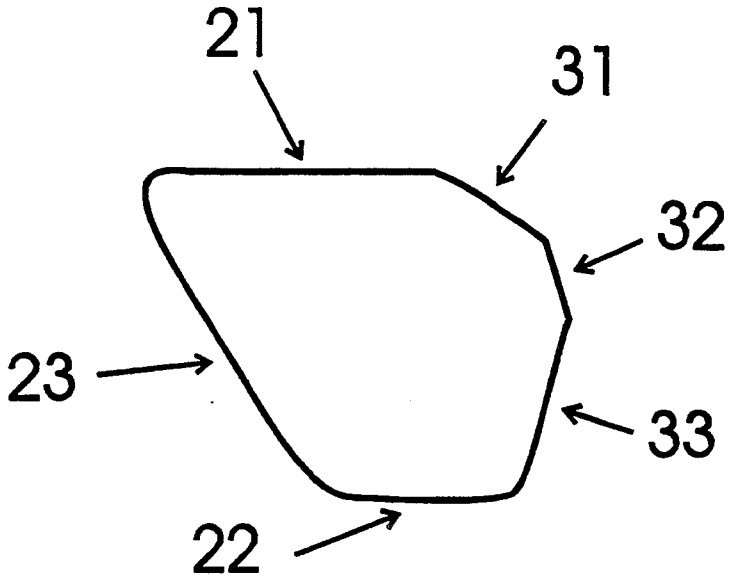
FIG. 3 Side Plan View

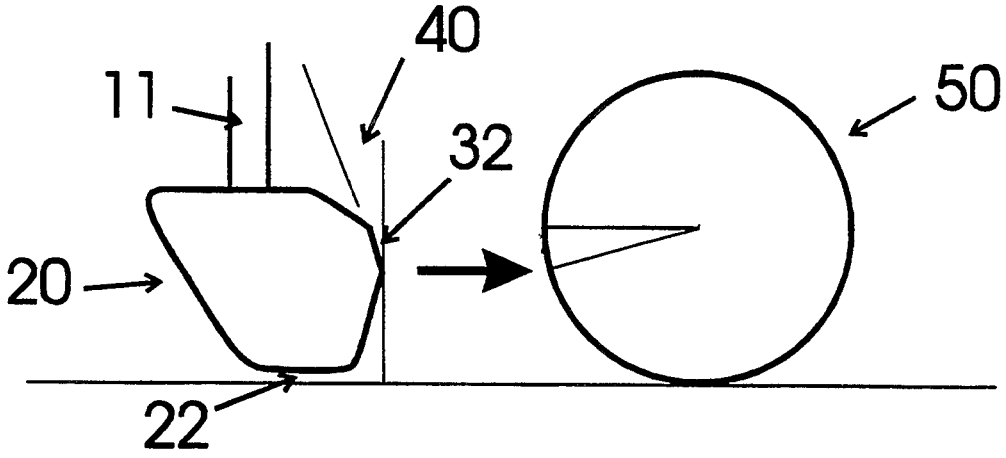
FIG. 4 Before Impact
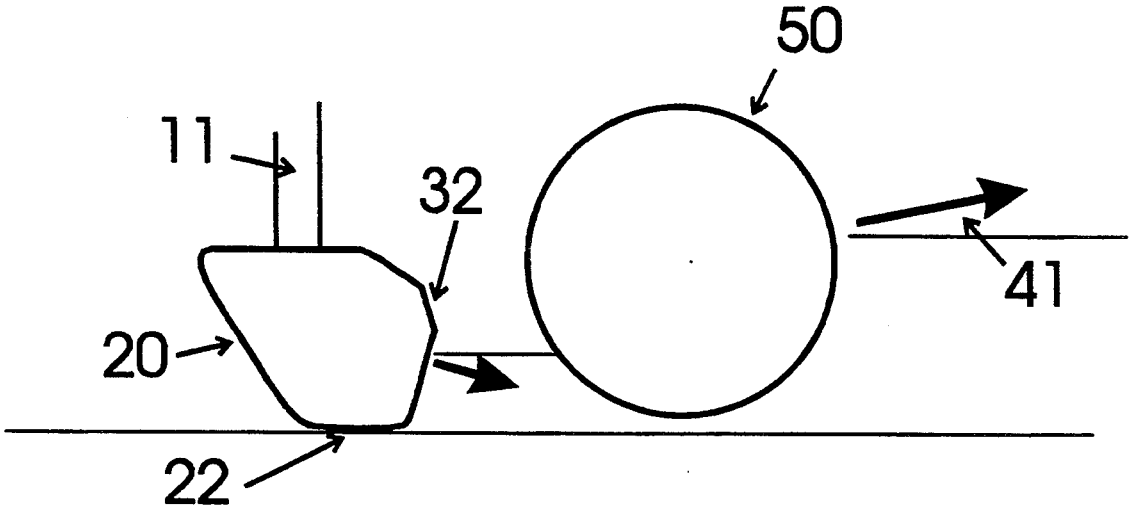
FIG. 5 After Impact

GOLF PUTTER AND PUTTER HEAD

BACKGROUND

The present invention relates to golf putters and particularly to a golf putter which is designed with a narrow, protruding striking face positioned on the putter head in a manner so as to strike consistently the golf ball slightly below its center. This invention minimizes or eliminates backspin or skid during the first part of the putt after the ball is impacted by the putter. A putter so designed is a significant improvement over prior art putters which impart backspin or skid to the golf ball for some distance after the ball is struck by the putter, until sliding friction between the ball and the grass surface imparts a rolling motion to the ball.

It is generally acknowledged that, the shorter the skid distance of a putted golf ball, the better its performance. This result is due, in part, to the coefficient of rolling friction which is generally much less than that of sliding friction, often as low as a very small fraction as much. Thus, a rolling ball will be less affected by surface irregularities of the green or impediments in the grass than a sliding ball. Reduction of skid minimizes the consequences of shortcomings in accuracy of alignment, errors in allowance for distance, the adverse effects of grain (direction of grass growth), and minor impediments which may be in the path of the ball in the first few inches of a putt.

In the prior art, when a golf ball is struck in its center by traditional putters being swung squarely in-line with the horizontal, the golf ball first skids without rolling for some distance before friction between the golf ball and the ground slows the golf ball's translational motion and induces a rolling action. This distance in which the golf ball skids before beginning to roll varies with the details of the prior art putter designs as well as the force of impact of the putter striking the ball. Efforts to minimize this skid condition in design and utilization of prior art putters have introduced other problems. For example, if the golf ball is struck above its horizontal center line, a forward spin will result, but the ball will momentarily be driven slightly downward, thereby increasing the normal or perpendicular force on the putting green. This downward force can significantly increase the undesirable effects of grain and other irregularities in the putting surface. Correspondingly, if the golf ball is struck much below the center line by a putter (without regard to the degree of loft built into the putter head), the golf ball will generally be lifted off the putting green, thereby reducing or eliminating the frictional force. However, in this latter case, the disadvantage is that, as the ball is being lifted, a significant amount of backspin may be introduced; this backspin will be present in the motion of the ball toward the target, producing skid which adversely affects control and predictability.

Prior art putters and golf clubs of which the inventor is aware include the following U.S. Pat. Nos.: MacKeil, 5,098,103, issued Mar. 24, 1992; Gebauer, 4,508,349, issued Apr. 2, 1985; Miller, 4,869,508, issued Sep. 26, 1989; Kinney, 4,725,062, issued Feb. 16, 1988; Schmidt, 4,521,022, issued Jun. 4, 1985; Masghati, 4,471,961, issued Sep. 18, 1984; Barr, 3,989,257, issued Nov. 2, 1976; Witherspoon, 3,759,527, issued Sep. 18, 1973; Solhelm, 3,625,518, issued Dec. 7, 1971; Baldwin, 3,368,812, issued Feb. 13, 1968; and Hinckley, 2,023,885, issued Apr. 5, 1934. The inventor is also aware of various other designs which may or may not be patented, such as the HMI II putter by Slotline and the PING putter by Karsten Solhelm. In all prior art designs of which the inventor is aware, including those mentioned above, the configuration of the striking face of the putter head is a continuous geometric shape, usually either flat or curved. One of the referenced patents, Gebauer, has three curved grooves on the striking face of a golf club. None of the references appear to teach a narrow striking surface protruding from or leading the driving face to control the area of impact so as to reduce substantially or eliminate miscues and the adverse effects of significant backspin.

The putter of the present invention has been designed with a front face which has been shaped to present to the ball a narrow impact surface, or striking surface, at an impact point on the ball slightly below the center line. The base of the putter head is positioned at an appropriate distance from the narrow striking face to provide the golfer with a convenient reference that enables him or her to strike the ball consistently at this point below the center line. At least a part of the impact surface of the putter protrudes or extends in front of the main body of the putter head such that the putter will strike the ball at the desired point below the center line even in the case of minor variations of alignment of the putter with respect to the desired horizontal stroke in hitting the ball. The narrow impact surface also minimizes the effects of any tendency to scoop under the ball which, as noted earlier, imparts excessive lift, backspin and skid, with undesirable effects. The position of the protruding narrow striking surface along the putter head, along with the distance from the impact surface to the base, providing a convenient ground reference, allows for the consistent imparting of forward momentum with a desired degree of lift and without imparting backspin or skidding to the ball; all of this combines to provide a significantly improved golf putter than is found in prior art.

SUMMARY

A golf putter is disclosed which incorporates a protruding, rearwardly angled or lofted striking surface that is located along the front face of the putter such that it consistently strikes the golf ball at a point slightly below the ball's center line. This design allows for the imparting of the desired forward momentum to the ball with a desired degree of lift and without imparting backspin and skid associated with prior art putter designs.

In this invention, a golf putter has been designed with a front face which is slanted or lofted to the back of the putter, and placed in front of the main putter body as may be seen in the accompanying drawings. The sloped striking face is placed a specific distance above the bottom of the putter, thereby providing the golfer a convenient reference, allowing the ball to be struck at a point just below the center with a high degree of consistency. The specific objectives that have been achieved by this design are as follows:

1. The putter provides a striking surface conveniently referenced to the bottom or base surface of the putter. This placement of the striking surface gives the golfer a great measure of control in striking the ball at a consistent point just below the ball's center line.

2. The striking surface is slanted or lofted rearwardly away from the ball such that the putter, when striking the ball, has a tendency to give a small amount of lift to the ball, thereby minimizing frictional interaction between the ball and the grass surface for the first part of the ball's travel toward its target.
3. The controlled striking of the ball at a point slightly below the center line avoids the tendency to introduce significant backspin into the motion of the ball.
4. The forward protrusion of at least a part of the lofted striking face of the putter and the vertical position of this striking surface relative to the putter bottom or base insure that the ball will be struck at a point slightly below the center line when used in a normal putting stroke with the base barely skimming the grass on the green. This optimal impact point will be hit even if the golfer's stroke is such that the shaft of the putter is not precisely vertical at the time the putter impacts the ball. This putter thus virtually eliminates undesirable downward motion or excessive lift associated with the performance of prior art putters when the golfer is not properly positioned above the ball at the time of the putt. If a right-handed golfer (using the fuller faced prior art putter design) stands with the ball too far forward of his left foot when putting, there is a tendency to strike the ball in a manner which imparts too much lift with backspin. Conversely, if the ball is positioned too far back of the right foot, a prior art putter will produce more of the downward motion on impact, as discussed earlier. The situations would be reversed for a left handed golfer. The design of the present invention compensates for such variations so that the point of impact on the ball remains very close to the desired point below the center line, regardless of maintenance of vertical alignment during the putting process.
5. While not a requirement of the invention, the subject putter head optimally may be relatively massive compared with prior art putters. Such larger mass in a range of 300 to 500 grams allows for a shorter backswing and a slower, more controlled putting motion with correspondingly increased accuracy in consistently striking the ball in line with the target or golf hole.

The present invention overcomes common problems associated with prior art putters by incorporating into the design the rearwardly angled or lofted narrow impact surface which is placed forward of the putter's center of mass. This enables a golfer consistently to strike the ball just below the center line, providing slight lift to the ball without inducing significant backspin or skidding. The forward location of the striking surface combines with the rearward angle or loft to provide a compensating mechanism to assist with problems associated with putter alignment at the time of impact with the golf ball. Finally, the lowest point of the putter provides a convenient reference surface at the exact distance from the bottom edge of the striking face to further assist the golfer in setting the height of the stroke as the putt is lined up.

Virtually all golf balls used in play in the United States have a standard diameter of approximately 1.68 inches, or about 42.68 mm. Recently, a slightly larger diameter golf ball has appeared on the market in the United States, and there are some balls in use in certain foreign countries which are of a smaller diameter than standard United States Golf Association specifications. The placement of the striking surface on the driving face of the putter, in relation to the bottom side of the putter head, will obviously vary in proportion to the diameter of the golf ball it is designed to hit, but the principles described herein remain the same. The shaft 11 attaches to the putter head 20 rearward of the front driving face 30.

BRIEF DESCRIPTION OF THE DRAWINGS

FIG. 1 is a perspective view of a putter according to the present invention.

FIG. 2 is a front plan view of the putter head.

FIG. 3 is a side plan view of the putter head.

FIG. 4 is a side plan view of the putter, a golf ball and the ground, just prior to the putter impacting the golf ball.

FIG. 5 is a side plan view of the putter, a golf ball and the ground, just after the putter has impacted the golf ball.

DETAILED DESCRIPTION OF THE DRAWINGS

Referring to FIG. 1, a golf club putter 10 is illustrated having a shaft 11 with a grip 12, attached to a putter head 20 at the opposite end thereof. The putter head 20 also has a bottom side 22, a rear side 23, a right side 24, a left side opposite the right side 24, and a front driving face 30. In the preferred embodiment, the bottom side 22 will have slightly rounded edges in the front and rear so as to minimize any tendency of the putter to catch the grass or other objects during the back or forward swing of the putter motion. However, this is not a necessary or limiting feature of the design.

Referring to the enlarged inset of FIG. 1, as further shown in FIGS. 2 and 3, the front driving face 30 consists of an upper surface 31, a protruding and narrow center striking surface 32, and a lower surface 33. The texture of the striking section 32 is not intended to be a limitation of the present invention as it can be smooth or it can be textured in various fashions, including lined, grooved, crisscrossed, or other textures or patterns. The actual dimensions of the putter head 20 and its elements are not intended to limit the present invention. Even so, in the optimal configuration of the putter certain relationships are of importance, including the location of the edge of striking surface 32. It is anticipated that a typical golfer of reasonable skill will be capable of operating the putter in such a fashion during the putting motion as to consistently cause the bottom side 22 of the putter head 20 to come very close to, if not slightly brush, the surface of the putting green without having the motion of the putter head 20 interrupted by making excessive direct contact with the green, as in a normal putting stroke. By operation in such a fashion, the bottom side 22 of the putter head 20 will brush along the blades of grass of the green as a stroke is made with the invention. The ability of the golfer to operate the putter in this fashion, coupled with the dimensions of the putter head, will cause the center striking section 32 to make contact with the golf ball, and for said contact to be made very close to, but just below the center line of said golf ball.

For example, referring to FIG. 4, for a golf ball 50 of diameter 1.68 inches or 4.27 cm, the width of the striking surface 32 of the putter head 20 could range from a line of infinitesional width to a surface of 1.3 cm width, and the distance from the lowest point center 22 of the putter and the center of the center striking surface 32 would be in the range of 1.3 cm to 2.0 cm. The striking surface 32 is also angled from the vertical at an angle of loft 40 from 0 degrees to 40 degrees measured from the perpendicular, said angle of loft preferably being about 20 degrees as shown in FIG. 4. The specific angle of loft is not intended to limit the present invention. The mass of the putter head 20 is not intended to limit the present invention. It is anticipated that golfers will have varying preferences with regard to the mass of the putter head 20. In the preferred embodiment, the putter head 20 is of significant mass, preferably approximating 300 to 500 grams. It is well understood in the field of putting that the shorter the backswing the less likely the typical golfer will make an error in aim or control on the forward swing of the putter. With a putter of mass approximately 300 to 500 grams, the typical golfer may find that a relatively greater mass aids in terms of achieving the required momentum of the putter during the putting motion using a shorter backswing thereby providing for a more consistent putting motion.

Referring to FIG. 5, during the putting motion, the putter head 20 will be drawn by the golfer closer to the golf ball 50 and its movement will preferably contain initially only a horizontal component of momentum. As the putter head 20 moves toward the golf ball 50, only the striking surface 32 makes contact with the golf ball 50 and imparts momentum to the golf ball 50 at an angle 41 to the horizontal as shown in FIG. 5. At this point the golf ball 50 has a larger component of horizontal momentum and a small vertical component of momentum. Correspondingly, after the impact, the putter head 20 will have a decreased horizontal forward momentum and will have a small component of vertical momentum directed downward.

One aspect of the invention is that the putter is deflected downward slightly upon impact and, through operation of the law of conservation of angular momentum, that downward deflection compensates for backspin which would otherwise be imparted to the golf ball by prior art putters, thus substantially reducing or eliminating backspin in the case of the invention.

A number of calculations have been made on a model of the invention configured as described in the drawings where angle 40 in FIG. 4 is 20°, with consideration given to the principles of conservation of linear and angular momenta. Various parameter choices were made to simulate as accurately as possible true field conditions.

As, an example of the results, consider the case of a putt with an initial speed of 7 ft/s (2.13 m/s) which corresponds to a relatively short putt. Using the invention, the velocity of the putter as it strikes the ball would be approximately 1.27 m/s. Immediately after the impact, the putter would have a velocity of approximately 1.08 m/s directed downward at an angle of approximately 1.78° from the horizontal. The significance of this deflection of the putter becomes apparent when the matter of angular rotation of the golf ball is considered. Taking the center of the golf ball as the reference origin, one can see that the initial angular momentum of the putter with respect to that reference is $2.31\times10^{-3}$ kg $m^2/s$, assuming that the putter strikes the ball at a point 10° corresponding to a distance of 0.36 cm below the center line. If the putter were not deflected downward in the impact, this angular momentum for this system would produce a significant backspin for the golf ball as is generally encountered using other putter designs. In this case, however, the small deflection of the putter means an increased angle between the putter's resultant momentum and the point of reference at the center of the ball. This slight downward deflection of the putter has the effect of offsetting the decrease in velocity of the putter. The final angular momentum of the putter with respect to the center of the ball taken as reference is $2.32\times10^{-3}$ kg $m^2/s$. This small difference in angular momentum will be compensated for by spin induced in the ball, which in this case would be a very slight forward spin. For other parameter choices, the results were not always this positive, but in every case the downward deflection of the putter in the collision greatly reduced any tendency to impart backspin to the ball when struck.

These calculations have been made in reference to the idealized model described above. A number of factors are difficult to quantify, including, in particular, the effect of frictional forces between the ball and the green. This frictional force between the ball and the green would, however, tend toward the imparting of forward spin to the ball at the time of impact, and, therefore, has a positive effect on the putting process.

A number of field tests have been performed on the invention. These have included still frame video pictures that graphically illustrate the performance of this putter in the manner described. In this video study, it is apparent that, upon impact, the ball is lifted slightly. It was also clearly demonstrated by viewing the video pictures that the ball generally had little or no tendency to skid and no tendency to develop a backspin. Other tests including the employment of four different experienced golfers to putt hundreds of times each at various specified distances from the hole on the same putting green, using prior art putters for half the putts and the subject invention for the other putts. The subject invention showed consistently better results for all distances as shown on the table below:

| Distance In Feet | Number of Balls Struck | % Putts Made Using Prior Art Putter | % Putts Made Using Subject Invention |
|---|---|---|---|
| 3 | 400 | 85 | 90 |
| 5 | 400 | 64 | 85 |
| 10 | 400 | 49 | 54 |
| 15 | 400 | 31 | 52 |
| 20 | 400 | 31 | 49 |
| Totals | 2,000 | 260 52% | 330 66% |

Additional field tests by three golf professionals also showed significantly superior results for the subject invention than prior art putters used by the same professionals under comparable conditions.

The discussion above has related in large part to a specific configuration of the subject invention. However, it is clear that other configurations can achieve comparable to less optimal results. Virtually any configuration which employs a rearwardly slanted or lofted striking surface whereby, in normal operation and play, the putter head can contact the target golf ball only in an area just below the center of the golf ball, will achieve results superior to prior art putters. Thus, for example, the putter head could be in the form of a cube or cylinder sphere with the driving face being formed by a "slice" off the front in such manner that only the driving face at a controlled height from the putting green can make contact with the target golf ball, the contact point being just below the center of the ball.

One of the important principles involved in the invention is the elimination of the possibility that the putter head can make contact with the golf ball at a point too low on the ball which could have a "scooping" effect producing undesirable backspin, or too high on the ball which would direct the ball toward the ground with excessive downward momentum and thereby magnify the undesirable effects of imperfections, obstructions or contour variations in or on the green. The invention capitalizes on the fact that the positioning of the striking surface at a certain distance from the base of the putter head will insure that the striking surface will strike the target golf ball at just the right spot for best results, taking into account the base's brushing near or touching the ground as each stroke is made by the putter. For a golf ball of the proper size resting on the putting green or ground, the controlled gliding of the putter head, just barely brushing the ground on its way toward the ball, will insure that the ball is struck at the right height by the striking surface to achieve best results.

What is claimed is:

1. A golf putter comprising:

a. a putter head having a planar striking surface with a generally horizontal bottom edge, said striking surface angled rearwardly from a vertical plane, wherein said bottom edge is forward of all other portions of said putter head and is positioned a vertical distance from the lowest point of said putter head in a range less than the radius of a target golf ball and more than half said radius; and b. a shaft attached to said putter head rearward of said striking surface.

2. A golf putter according to claim 1 wherein said striking surface is angled rearwardly from a vertical plane not more than 20 degrees from the perpendicular.

3. A golf putter according to claim 2 wherein said bottom edge is positioned a vertical distance from said lowest point of said putter head in a range less than 21 mm and more than 10 mm.

4. A golf putter according to claim 2 wherein the mass of said putter head is in a range of 300 to 500 grams.

5. A golf putter according to claim 1 wherein said bottom edge is positioned a vertical distance from said lowest point of said putter head in a range less than 21 mm and more than 10 mm.

6. A golf putter according to claim 5 wherein the mass of said putter head is in a range from 300 to 500 grams.

7. A golf putter according to claim 1 wherein the mass of said putter head is in a range from 300 to 500 grams.

8. A golf putter head comprising a planar striking surface with a generally horizontal bottom edge, said striking surface angled rearwardly from a vertical plane, wherein said bottom edge is forward of all other portions of said putter head and is positioned a vertical distance from the lowest point of said putter head in a range less than the radius of a target golf ball and more than half said radius.

9. A golf putter head according to claim 8 wherein said striking surface is angled rearwardly from a vertical plane not more than 20 degrees from the perpendicular.

10. A golf putter head according to claim 9 wherein said bottom edge is positioned a vertical distance from said lowest point of said putter head in a range of less than 21 mm and more than 10 mm.

11. A golf putter head according to claim 9 wherein the mass of said putter head is in a range of 300 to 500 grams.

12. A golf putter head according to claim 8 wherein said bottom edge is positioned a vertical distance from said lowest point of said putter head n a range less than 21 mm and more than 10 mm.

13. A golf putter head according to claim 12 wherein the mass of said putter head is in a range of 300 to 500 grams.

14. A golf putter head according to claim 8 wherein the mass of said putter head is in a range of 300 to 500 grams.

15. A golf putter comprising:

a. a putter head having a planar striking surface with a generally horizontal bottom edge, said striking surface angled rearwardly from a vertical plane, wherein said bottom edge is forward of all other portions of said putter head and is positioned a vertical distance from the lowest point of said putter head in a range less than 21 mm and more than 10 mm; and b. a shaft attached to said putter head rearward of said striking surface.

16. A golf putter according to claim 15 wherein said striking surface is angled rearwardly from a vertical plane not more than 20 degrees from the perpendicular.

17. A golf putter according to claim 16 wherein the mass of said putter head is in a range from 300 to 500 grams.

18. A golf putter according to claim 15 wherein the mass of said putter head is in a range from 300 to 500 grams.

19. A golf putter head comprising a planar striking surface with a generally horizontal bottom edge, said striking surface angled rearwardly from a vertical plane, wherein said bottom edge is forward of all other portions of said putter head and is positioned a vertical distance from the lowest point of said putter head in a range less than 21 mm and more than 10 min.

20. A golf putter head according to claim 19 wherein said striking surface is angled rearwardly from a vertical plane not more than 20 degrees from the perpendicular.

21. A golf putter head according to claim 20 wherein the mass of said putter head is in a range from 300 to 500 grams.

22. A golf putter head according to claim 19 wherein the mass of said putter head is in a range from 300 to 500 grams.

* * * * *